US010697239B2

(12) United States Patent
Astor et al.

(10) Patent No.: US 10,697,239 B2
(45) **Date of Patent: *Jun. 30, 2020**

(54) ELECTRICIAN'S LADDER AND METHOD

(71) Applicant: Werner Co., Greenville, PA (US)

(72) Inventors: Kyle G. Astor, Meadville, PA (US); James J. Grebinoski, Mercer, PA (US); Craig Werner, Lake Forest, IL (US); Kevin J. Moran, Gurnee, IL (US)

(73) Assignee: Werner Co., Greenville, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/610,913

(22) Filed: Jan. 30, 2015

(65) Prior Publication Data

US 2015/0136524 A1 May 21, 2015

Related U.S. Application Data

(62) Division of application No. 13/199,743, filed on Sep. 8, 2011, now Pat. No. 8,944,213, which is a division of application No. 12/657,062, filed on Jan. 13, 2010, now Pat. No. 8,016,078, which is a division of application No. 11/358,626, filed on Feb. 21, 2006, now Pat. No. 7,886,872.

(51) Int. Cl.

| | |
|---|---|
| ***E04G 7/14*** | (2006.01) |
| ***E06C 7/14*** | (2006.01) |
| ***E06C 1/39*** | (2006.01) |
| ***E06C 1/28*** | (2006.01) |

(52) U.S. Cl.

CPC ..... *E06C 7/14* (2013.01); *E06C 1/28* (2013.01); *E06C 1/39* (2013.01); *Y10T 83/04* (2015.04); *Y10T 83/0596* (2015.04)

(58) Field of Classification Search

CPC ..... E04G 7/14

See application file for complete search history.

(56) References Cited

U.S. PATENT DOCUMENTS

| | | | | |
|---|---|---|---|---|
| 4,318,454 | A * | 3/1982 | Johnson | 182/129 |
| 4,533,091 | A * | 8/1985 | Knight et al. | 242/129.6 |
| 5,509,671 | A * | 4/1996 | Campbell | B62B 1/264 242/557 |
| 6,557,333 | B2 * | 5/2003 | Swart et al. | 56/16.6 |
| 7,931,227 | B1 * | 4/2011 | Oudekerk | B65H 49/32 242/403.1 |
| 2002/0185576 | A1 * | 12/2002 | Harper | 248/210 |
| 2005/0061584 | A1 * | 3/2005 | Louthen | 182/129 |

* cited by examiner

*Primary Examiner* — Alvin C Chin-Shue

(74) *Attorney, Agent, or Firm* — Ansel M. Schwartz

(57) ABSTRACT

A stepladder having a front side, a rear side and a top. The stepladder can include a conduit holder attached to the front side for holding conduit. The stepladder can include a first wire spool holder attached to the front side and a second wire spool holder attached to the rear side though which a conduit having a wire spool extends. The stepladder can include a hacksaw hook attached to the front side. A method for cutting a conduit. A method for using a hacksaw. A method for obtaining wire.

6 Claims, 6 Drawing Sheets

ELECTRICIAN'S LADDER AND METHOD

CROSS-REFERENCE TO RELATED APPLICATIONS

This application is a divisional of U.S. patent application Ser. No. 13/199,743 filed Sep. 8, 2011, now U.S. Pat. No. 8,944,213, which is a divisional of U.S. patent application Ser. No. 12/657,062 filed Jan. 13, 2010, now U.S. Pat. No. 8,016,078 issued Sep. 13, 2011, which is a divisional of U.S. patent application Ser. No. 11/358,626 filed Feb. 21, 2006, now U.S. Pat. No. 7,886,872 issued Feb. 15, 2011, all of which are incorporated by reference herein.

FIELD OF THE INVENTION

The present invention is related to a ladder to assist electricians. More specifically, the present invention is related to a ladder to assist electricians having a conduit holder, hacksaw hook and a wire spool holder.

BACKGROUND OF THE INVENTION

For years, stepladders have been designed for the general construction and painting professionals needs. Bauer Corporation provides a ladder vise, U.S. Pat. No. 4,318,454 that attaches to a stepladder to hold materials securely. This vise requires the user to first operate the vise on one side and place the conduit in and then open the opposite side and place the conduit in to hold it firmly. This holder is a spring loaded sliding design that will hold a variety of materials.

The new electrician's ladder of the present invention is designed for the specific needs of the electrician. New features have been added to aid in the installation of conduit, running wires, and tool storage. These added features help make the electrician's job safer and more efficient.

SUMMARY OF THE INVENTION

The present invention pertains to a stepladder. The stepladder comprises a front side. The front side is comprised of a first front rail, and a second front rail in parallel with the first front rail and in spaced relationship therewith. The front side is also comprised of a plurality of front rungs. Each front rung being connected to the first front rail and the second front rail and perpendicular thereto. Each front rung in parallel and in spaced relationship with the other front rungs. The stepladder comprises a rear side. The rear side is comprised of a first rear rail and a second rear rail in parallel with the first rear rail and in spaced relationship therewith. The rear side also comprised of a plurality of rear rungs. Each rear rung connected to the first rear rail and the second rear rail and perpendicular thereto. Each rear rung in parallel and in spaced relationship with the other rear rungs. The stepladder comprises a top. The front side and rear side fixedly attached to the top such that the front side and rear side can be folded together into a closed position where the front side and rear side are essentially in parallel or opened about the top into an operational position where the front side and rear side are at an angular relationship and a workman can climb to a desired rung and perform whatever work is desired. The stepladder comprises a conduit holder attached to the front side for holding conduit.

The present invention pertains to a stepladder. The stepladder comprises a front side. The front side is comprised of a first front rail, and a second front rail in parallel with the first front rail and in spaced relationship therewith. The front side is also comprised of a plurality of front rungs. Each front rung being connected to the first front rail and the second front rail and perpendicular thereto. Each front rung in parallel and in spaced relationship with the other front rungs. The stepladder comprises a rear side. The rear side is comprised of a first rear rail and a second rear rail in parallel with the first rear rail and in spaced relationship therewith. The rear side is also comprised of a plurality of rear rungs. Each rear rung connected to the first rear rail and the second rear rail and perpendicular thereto. Each rear rung in parallel and in spaced relationship with the other rear rungs. The stepladder comprises a top. The front side and rear side fixedly attached to the top such that the front side and rear side can be folded together into a closed position where the front side and rear side are essentially in parallel or opened about the top into an operational position where the front side and rear side are at an angular relationship and a workman can climb to a desired rung and perform whatever work is desired. The stepladder comprises a hacksaw hook attached to the front side.

The present invention pertains to a stepladder. The stepladder comprises a front side. The front side comprised of a first front rail, and a second front rail in parallel with the first front rail and in spaced relationship therewith. The front side also comprised of a plurality of front rungs. Each front rung being connected to the first front rail and the second front rail and perpendicular thereto. Each front rung in parallel and in spaced relationship with the other front rungs. The stepladder comprises a rear side. The rear side comprised of a first rear rail and a second rear rail in parallel with the first rear rail and in spaced relationship therewith. The rear side also comprised of a plurality of rear rungs. Each rear rung connected to the first rear rail and the second rear rail and perpendicular thereto. Each rear rung in parallel and in spaced relationship with the other rear rungs. The stepladder comprises a top. The front side and rear side fixedly attached to the top such that the front side and rear side can be folded together into a closed position where the front side and rear side are essentially in parallel or opened about the top into an operational position where the front side and rear side are at an angular relationship and a workman can climb to a desired rung and perform whatever work is desired. The stepladder comprises a first wire spool holder attached to the front side and a second wire spool holder attached to the rear side though which a conduit having a wire spool extend.

The present invention pertains to a stepladder. The stepladder comprises a front side. The front side comprised of a first front rail, and a second front rail in parallel with the first front rail and in spaced relationship therewith. The front side also comprised of a plurality of front rungs. Each front rung being connected to the first front rail and the second front rail and perpendicular thereto. Each front rung in parallel and in spaced relationship with the other front rungs. The stepladder comprises a rear side. The rear side comprised of a first rear rail and a second rear rail in parallel with the first rear rail and in spaced relationship therewith. The rear side also comprised of a plurality of rear rungs. Each rear rung connected to the first rear rail and the second rear rail and perpendicular thereto. Each rear rung in parallel and in spaced relationship with the other rear rungs. The stepladder comprises a top. The front side and rear side fixedly attached to the top such that the front side and rear side can be folded together into a closed position where the front side and rear side are essentially in parallel or opened about the top into an operational position where the front side and rear side are at an angular relationship and a workman can climb to a desired rung and perform whatever work is desired. The stepladder comprises a conduit holder attached to the front side for holding conduit. The stepladder comprises a first wire spool holder attached to the front side and a second wire spool holder attached to the rear side though which a conduit having a wire spool extend. The stepladder comprises a hacksaw hook attached to the front side.

The present invention pertains to a method for cutting a conduit. The method comprises the steps of moving a conduit holder of a front side of a stepladder into an open position. There is the step of placing the conduit on the conduit holder. There is the step of cutting the conduit while it is on the conduit holder.

The present invention pertains to a method for using a hacksaw. The method comprises the steps of taking the hacksaw off of a hacksaw hook attached in proximity to a center of a rung of a front side of a stepladder. There is the step of cutting an object with the hacksaw.

The present invention pertains to a method for obtaining wire. The method comprises the steps of placing a first end of a conduit having a wire spool through a first wire spool holder of a front side of a stepladder. There is the step of placing a second end of the conduit through a second wire spool holder of a rear side of the stepladder so the wire spool is between the front side and the rear side of the ladder on the conduit. There is the step of unwinding wire from the wire spool.

BRIEF DESCRIPTION OF THE DRAWINGS

In the accompanying drawings, the preferred embodiment of the invention and preferred methods of practicing the invention are illustrated in which.

DETAILED DESCRIPTION

Figure 1:
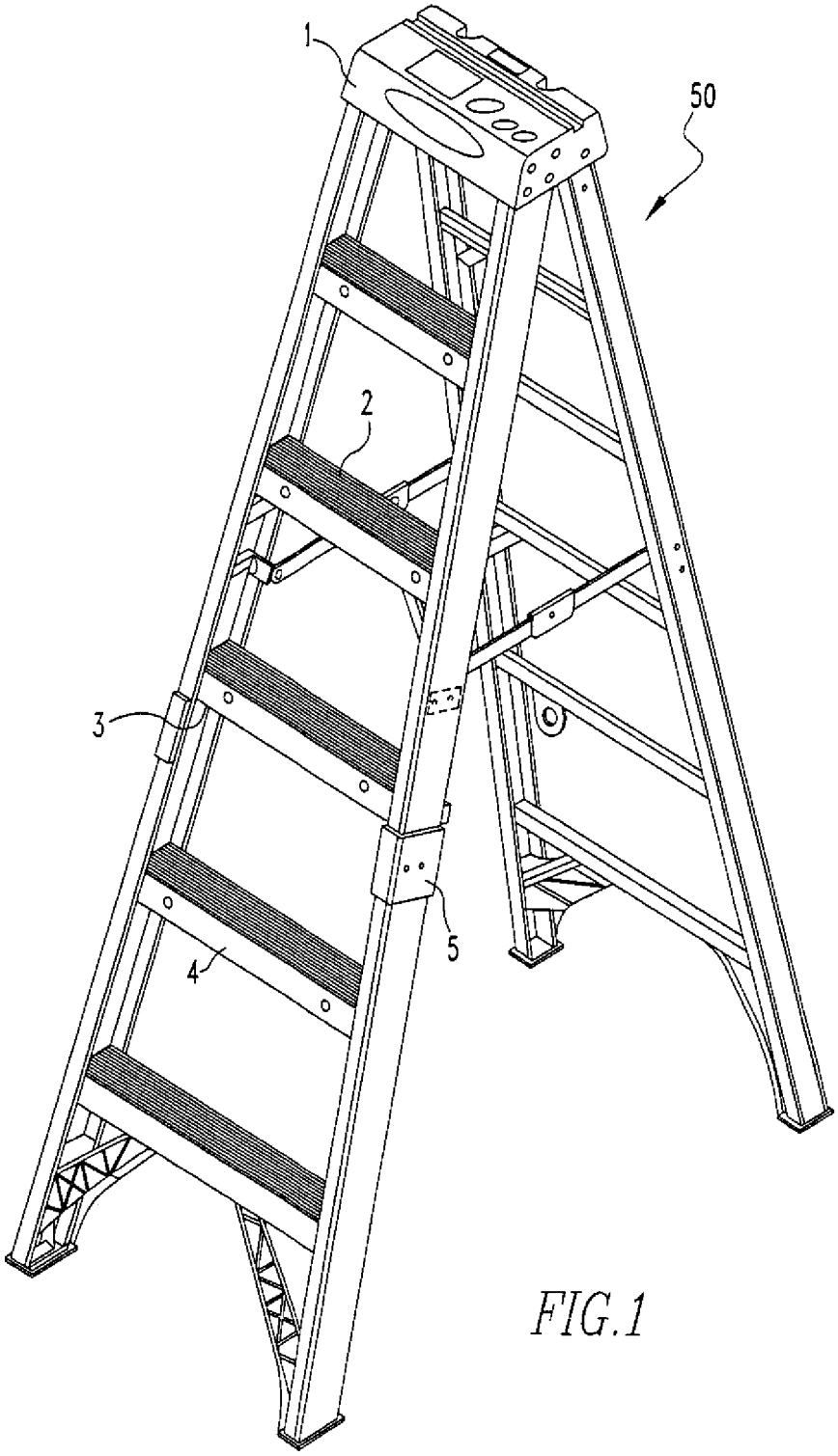
FIG. 1 is a schematic representation of a stepladder of the present invention.

Referring now to the drawings wherein like reference numerals refer to similar or identical parts throughout the several views, and more specifically to FIG. 1 thereof, there is shown a stepladder 50. The stepladder 50 comprises a front side 52. The front side 52 comprised of a first front rail 56, and a second front rail 58 in parallel with the first front rail 56 and in spaced relationship therewith. The front side 52 also comprised of a plurality of front rungs 60. Preferably, the rungs 60 are steps 11. Each front rung 60 being connected to the first front rail 56 and the second front rail 58 and perpendicular thereto. Each front rung 60 in parallel and in spaced relationship with the other front rungs 60. The stepladder 50 comprises a rear side 54. The rear side 54 comprised of a first rear rail 62 and a second rear rail 64 in parallel with the first rear rail 62 and in spaced relationship therewith. The rear side 54 also comprised of a plurality of rear rungs 66. Each rear rung 66 connected to the first rear rail 62 and the second rear rail 64 and perpendicular thereto. Each rear rung 66 in parallel and in spaced relationship with the other rear rungs 66. The stepladder comprises a top 1. The front side 52 and rear side 54 fixedly attached to the top 1 such that the front side 52 and rear side 54 can be folded together into a closed position where the front side 52 and rear side 54 are essentially in parallel or opened about the top 1 into an operational position where the front side 52 and rear side 54 are at an angular relationship and a workman can climb to a desired rung 60 and perform whatever work is desired. The stepladder 50 comprises a conduit holder 3 attached to the front side 52 for holding conduit 6.

Preferably, the conduit holder 3 includes a first side shield 5*a* and a second side shield 5*b* attached to the first front rail 56 and the second front rail 58, respectively, to protect the respective front rail. The conduit holder 3 preferably includes a first hook 7*a* and a second hook 7*b*, and a bar 8 to which the first and second hooks are connected in alignment with each other; by moving the bar 8, the first and second hooks move in unison with the bar 8 between a retracted position and an open position. Preferably, the conduit holder 3 includes a first mounting bracket 9*a* connected to the first front rail 56 and the first hook 7*a*, and a second mounting bracket 9*b* connected to the second front rail 58 and the second hook 7*b*.

The present invention pertains to a stepladder 50. The stepladder 50 comprises a front side 52. The front side 52 comprised of a first front rail 56, and a second front rail 58 in parallel with the first front rail 56 and in spaced relationship therewith. The front side 52 also comprised of a plurality of front rungs 60. Each front rung 60 being connected to the first front rail 56*b* and the second front rail 58 and perpendicular thereto. Each front rung 60 in parallel and in spaced relationship with the other front rungs 60. The stepladder 50 comprises a rear side 54. The rear side 54 comprised of a first rear rail 62 and a second rear rail 64 in parallel with the first rear rail 62 and in spaced relationship therewith. The rear side 54 also comprised of a plurality of rear rungs 66. Each rear rung 66 connected to the first rear rail 62 and the second rear rail 64 and perpendicular thereto. Each rear rung 66 in parallel and in spaced relationship with the other rear rungs 66. The stepladder comprises a top 1. The front side 52 and rear side 54 fixedly attached to the top 1 such that the front side 52 and rear side 54 can be folded together into a closed position where the front side 52 and rear side 54 are essentially in parallel or opened about the top 1 into an operational position where the front side 52 and rear side 54 are at an angular relationship and a workman can climb to a desired rung 60 and perform whatever work is desired. The stepladder comprises a hacksaw hook attached to the front side or the rear side. Preferably, the hacksaw hook is attached to the rear in proximity to the center of a rung of the front side.

The present invention pertains to a stepladder 50. The stepladder 50 comprises a front side 52. The front side 52 comprised of a first front rail 56, and a second front rail 58 in parallel with the first front rail 56 and in spaced relationship therewith. The front side 52 also comprised of a plurality of front rungs 60. Each front rung 60 being connected to the first front rail 56 and the second front rail 58 and perpendicular thereto. Each front rung 60 in parallel and in spaced relationship with the other front rungs 60. The stepladder 50 comprises a rear side 54. The rear side 54 comprised of a first rear rail 62 and a second rear rail 64 in parallel with the first rear rail 62 and in spaced relationship therewith. The rear side 54 also comprised of a plurality of rear rungs 66. Each rear rung 66 connected to the first rear rail 62 and the second rear rail 64 and perpendicular thereto. Each rear rung 66 in parallel and in spaced relationship with the other rear rungs 66. The stepladder comprises a top 1.

The front side 52 and rear side 54 fixedly attached to the top 1 such that the front side 52 and rear side 54 can be folded together into a closed position where the front side 52 and rear side 54 are essentially in parallel or opened about the top 1 into an operational position where the front side 52 and rear side 54 are at an angular relationship and a workman can climb to a desired rung 60 and perform whatever work is desired. The stepladder 50 comprises a first wire spool holder 4*a* attached to the front side 52 and a second wire spool holder 4*b* attached to the rear side 54 though which a conduit 6 having a wire spool 12 extends.

Preferably, the first wire spool holder 4*a* and the second wire spool holder 4*b* are disposed at a same level on the front side 52 and the rear side 54, respectively. The first and second wire spool holders each preferably include a ring 68 through which the conduit 6 extends.

The present invention pertains to a stepladder 50. The stepladder 50 comprises a front side 52. The front side 52 comprised of a first front rail 56, and a second front rail 58 in parallel with the first front rail 56 and in spaced relationship therewith. The front side 52 also comprised of a plurality of front rungs 60. Each front rung 60 being connected to the first front rail 56 and the second front rail 58 and perpendicular thereto. Each front rung 60 in parallel and in spaced relationship with the other front rungs 60. The stepladder 50 comprises a rear side 54. The rear side 54 comprised of a first rear rail 62 and a second rear rail 64 in parallel with the first rear rail 62 and in spaced relationship therewith. The rear side 54 also comprised of a plurality of rear rungs 66. Each rear rung 66 connected to the first rear rail 62 and the second rear rail 64 and perpendicular thereto. Each rear rung 66 in parallel and in spaced relationship with the other rear rungs 66. The stepladder comprises a top 1. The front side 52 and rear side 54 fixedly attached to the top 1 such that the front side 52 and rear side 54 can be folded together into a closed position where the front side 52 and rear side 54 are essentially in parallel or opened about the top 1 into an operational position where the front side 52 and rear side 54 are at an angular relationship and a workman can climb to a desired rung 60 and perform whatever work is desired. The stepladder comprises a conduit holder 3 attached to the front side 52 for holding conduit 6. The stepladder 50 comprises a first wire spool holder 4*a* attached to the front side 52 and a second wire spool holder 4*b* attached to the rear side 54 though which a conduit 6 having a wire spool 12 extends. The stepladder 50 comprises a hacksaw hook 2 attached to the front side 52 or rear side 54.

The present invention pertains to a method for cutting a conduit 6. The method comprises the steps of moving a conduit holder 3 of a front side 52 of a stepladder 50 into an open position. There is the step of placing the conduit 6 on the conduit holder 3. There is the step of cutting the conduit 6 while it is on the conduit holder 3.

The present invention pertains to a method for using a hacksaw. The method comprises the steps of taking the hacksaw off of a hacksaw hook 2 attached in proximity to a center of a rung 60 or step 11 of a front side 52 of a stepladder 50. There is the step of cutting an object with the hacksaw.

The present invention pertains to a method for obtaining wire. The method comprises the steps of placing a first end of a conduit 6 having a wire spool 12 through a first wire spool holder 4*a* of a front side 52 of a stepladder 50. There is the step of placing a second end of the conduit 6 through a second wire spool holder 4*b* of a rear side 54 of the stepladder 50 so the wire spool 12 is between the front side 52 and the rear side 54 of the ladder 50 on the conduit 6. There is the step of unwinding wire from the wire spool 12.

In the operation of the preferred embodiment, several features have been added to a stepladder to assist electricians.

Conduit Holder 3

When an electrician wants to cut a piece of conduit, he braces the conduit with his knee between the rivet heads on the third step from the bottom. The new integrated conduit holder secures the conduit between the conduit holder hooks and the protective rail shield for easy and safer cutting.

Hacksaw Hook 7

Electricians will tape or screw hooks onto the outside of their ladder rail to holder their hacksaws when not in use. These hooks are often mounted on the outside of the rail. They will then hang heavy tool belts and buckets that could tip the ladder over. The integrated hacksaw hook is placed in the inside of the frame on the center of the step of the ladder so not to create a tipping hazard and is firmly secured to the step.

Wire Spool Holder 4

When a stepladder is used as a wire caddy the users will rest the conduit on the top of the front step and through the top of the rear horizontal. This allows the conduit to move when the wire is being used, and is not level. The new integrated wire spool holder provides adequate support for conduit while keeping the conduit in place and level.

The Electrician's Jobstation is a new ladder design based off of the IAA platform. There are four new and innovative features that make up the new design. The new design has a plastic top 1, as shown in FIG. 1, with features designed to benefit an electrician, a conduit holder 3 with side shields 5, a hacksaw hook 2, and two sets of wire spool holders 4. See U.S. patent application Ser. No. 11/347,613, incorporated by reference herein.

The top 1 has many new features designed especially for the electrician. The top 1 has screw driver holes a hammer/drill holster. The top also features slots for channel locks, side cutters, pliers, and wire strippers. Each of the features has a raised icon next to it for easy identification.

Figure 2:
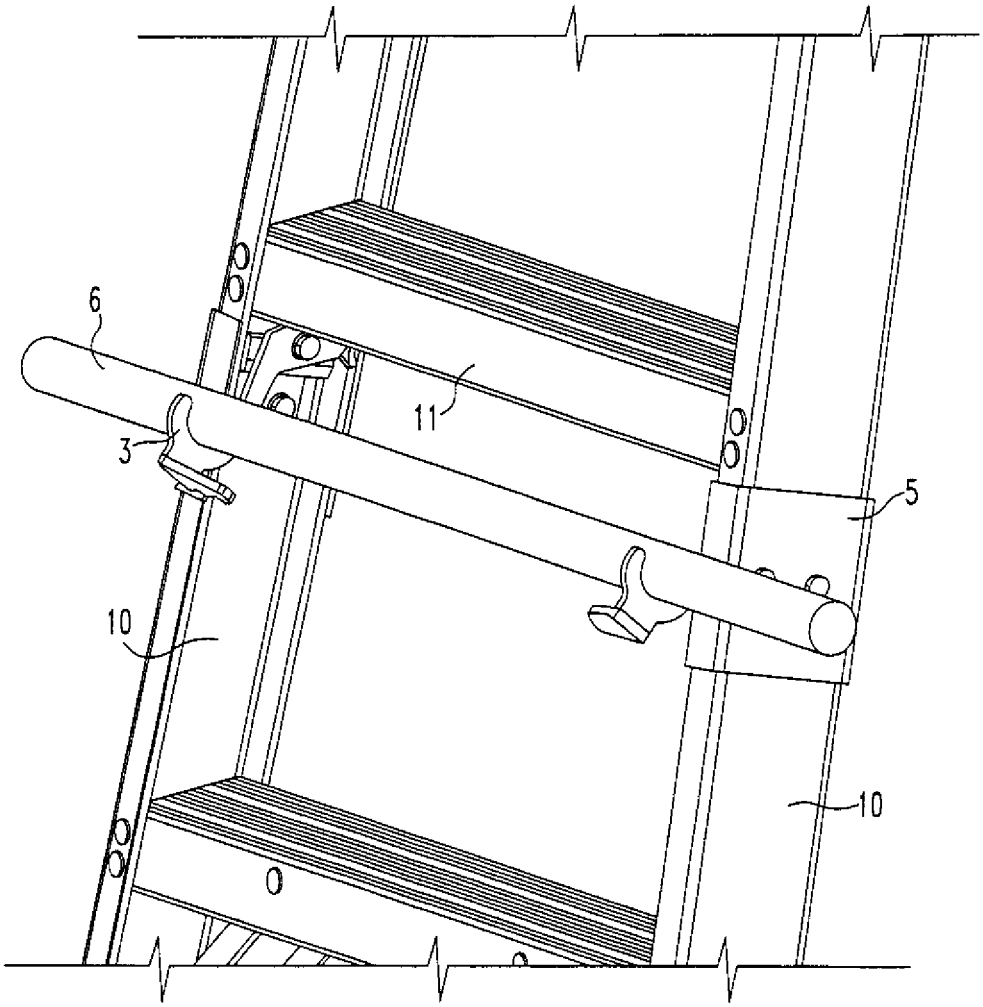
FIG. 2 is a schematic representation of a conduit holder in an open position with conduit.
Figure 3:
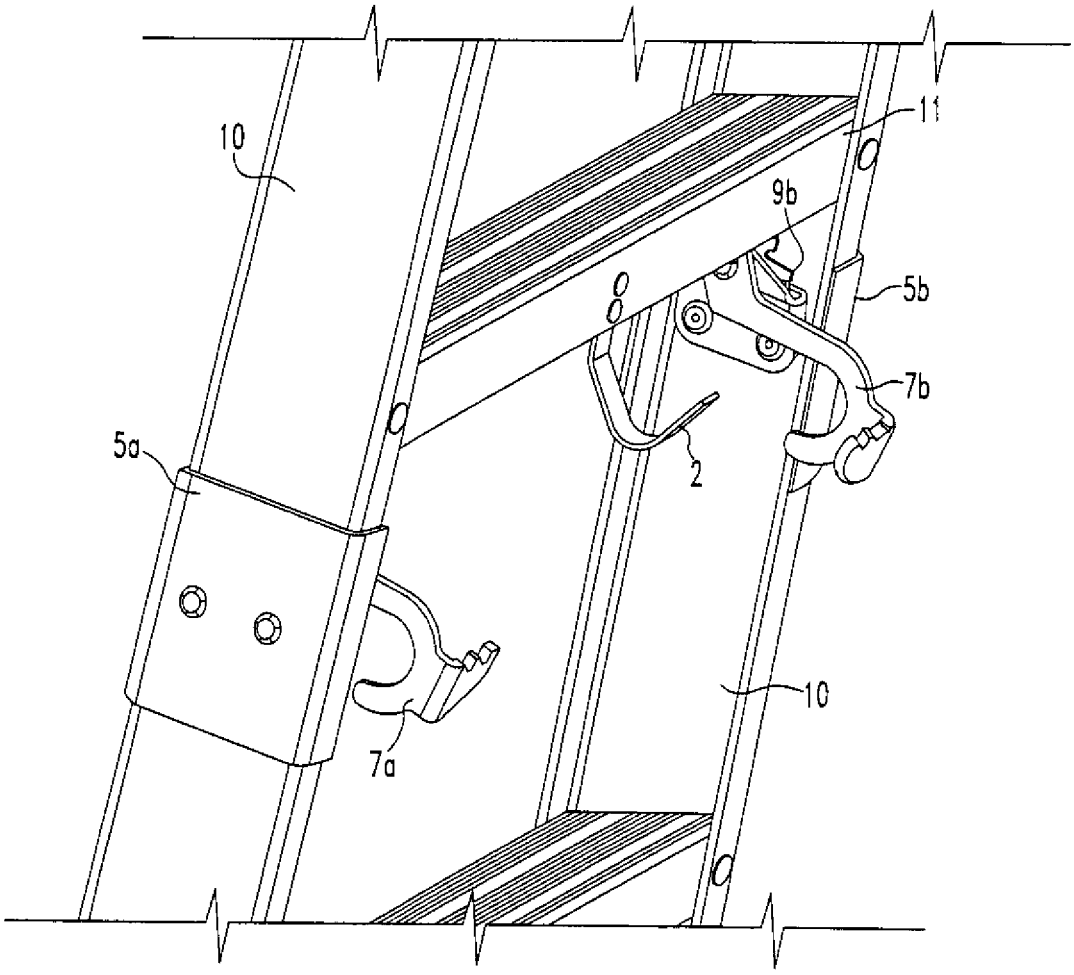
FIG. 3 is a schematic representation of a conduit holder in a retracted position and the hacksaw hook.
Figure 4:
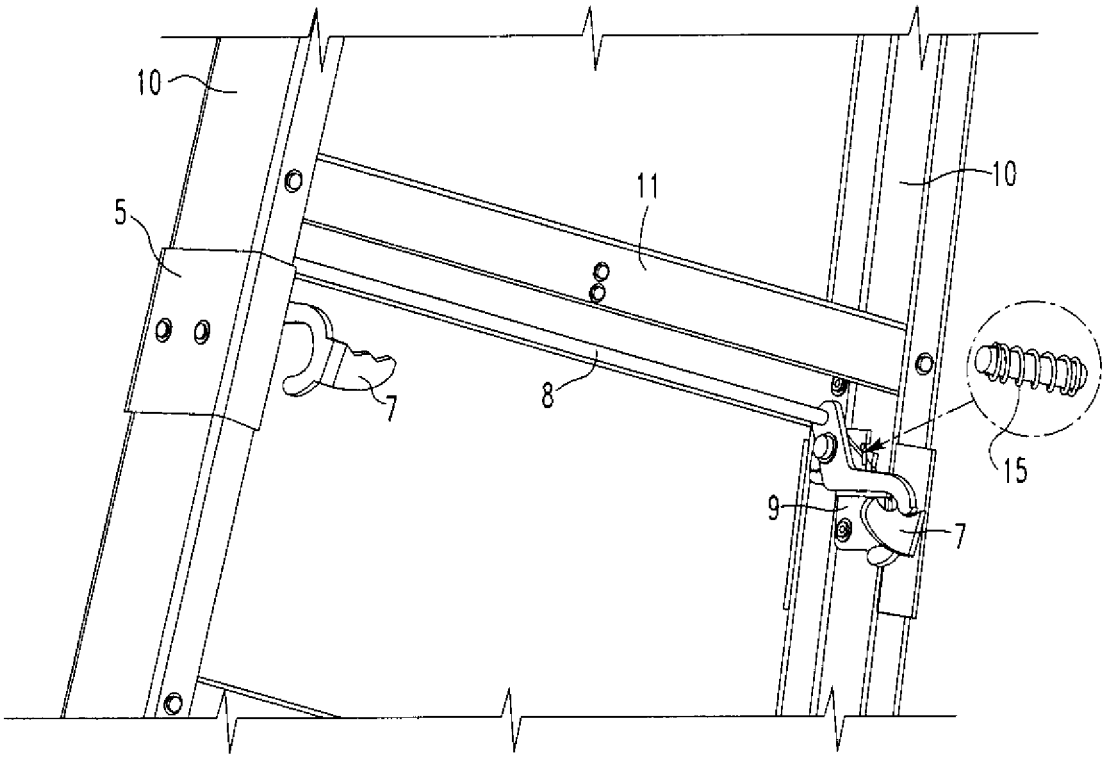
FIG. 4 is a schematic representation of a conduit holder in an open position.

The conduit holder 3, as shown in FIG. 2, is designed to hold various sizes of conduit 6 up to one inch in diameter. FIG. 3 shows the conduit holder 3 with the hooks 7 in the retracted resting position. FIG. 4 shows the conduit holder 3 in the open position. The hooks are connected by a bar 8 and are mounted to the side rails of the ladder 10 with the mounting brackets 9. The bar 8 allows the user to operate both hooks 7 with one hand. This one handed operation allows for safer handling of materials and tools. Attached to the rail 10 are side shields 5. The side shields protect the rail 10 from being damaged by the conduit 6 or an errant cut by a hacksaw. To use the conduit holder 3, the user has to pull the hooks 7 toward himself and then place the conduit 6 in the hooks 7 (See FIG. 2). The conduit 6 then rests on the rail shields 5. Once the conduit 6 is pulled out of the hooks 7, the hooks 7 they will retract.

Mounted on the rear of the front step 11, as shown in FIG. 3, is the hacksaw hook 2. This hook 2 is mounted on the rear of the same step 11 as the conduit holder 7. After the user is finished cutting the conduit 6, as shown in FIG. 2, he can hang the hacksaw on the hook 2 and retrieve another piece of conduit 6 to cut.

Figure 5:
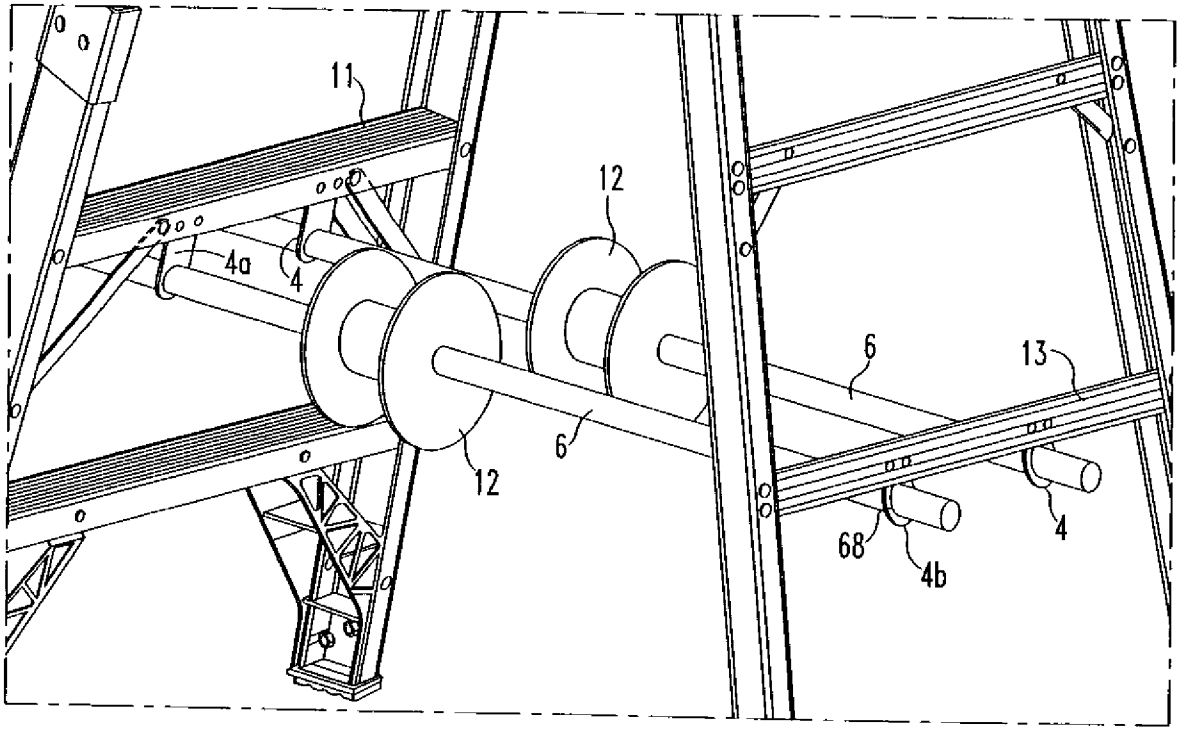
FIG. 5 is a schematic representation of the wire spool holders with wire spools on conduits.

The wire spool holders 4, as shown in FIG. 5, are mounted on the front step 11 and on the rear horizontal 13. The wire spools 12 are placed onto the conduit 6 before they are inserted thru one of the spool holders 4 and then through the one opposite. The spool holders 4 are mounted so that the conduit 6 is level and the wire spools do not all shift to one side of the ladder and bind.

Figure 6:
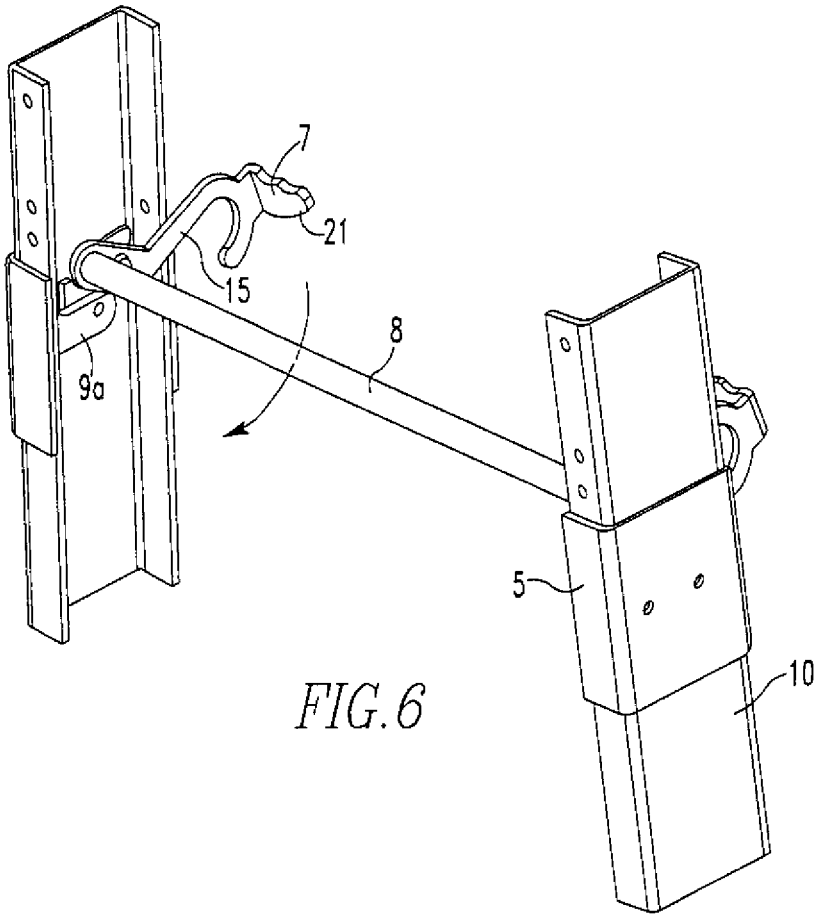
FIG. 6 is a schematic representation of the conduit holder.
Figure 7:
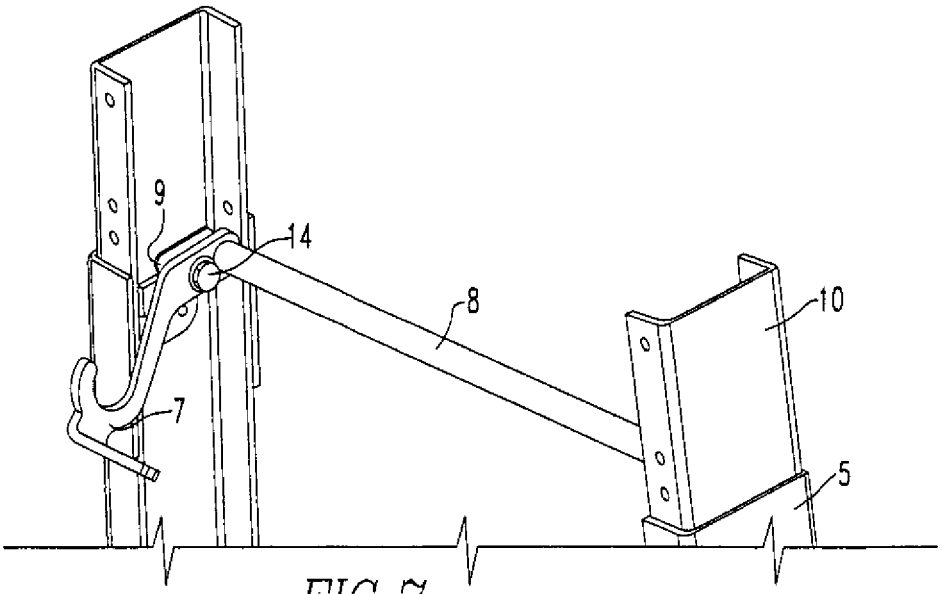
FIG. 7 is a schematic representation of the conduit holder.

The conduit holder 3 is further described in FIGS. 6 and 7. The hooks 7 are welded to the bar 8 which makes them move together. The pivot point 14 attaches the hooks 7 to the rail 10. The user will grab the hook 7 and pull it towards himself. The handle 21 on hook 7 is not necessary but aids the user in gripping the hook 7. The spring 15 automatically retracts the whole assembly when the user is done.

The conduit holder is limited by the step 11, as shown in FIG. 2. The front of the step 11 will stop the holder when it is coming forward and the rear of step 11 will stop it when it retracts.

The recommend weight limit for the wire spool holders 4 is 375 lbs, (the same as the duty rating of the ladder).

The hacksaw hook 2 is meant to hold a hacksaw and is labeled as such. It was designed to hold 250 lbs in cases of accidental overloading.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. A stepladder comprising:

a front side, said front side comprised of a first front rail, and a second front rail in parallel with the first front rail and in spaced relationship therewith, said front side also comprised of a plurality of front rungs, each front rung being connected to the first front rail and the second front rail and perpendicular thereto, each front rung in parallel and in spaced relationship with the other front rungs;

a rear side, said rear side comprised of a first rear rail and a second rear rail in parallel with the first rear rail and in spaced relationship therewith, said rear side also comprised of a plurality of rear rungs, each rear rung connected to the first rear rail and the second rear rail and perpendicular thereto, each rear rung in parallel and in spaced relationship with the other rear rungs;

a top, said front side and rear side attached to the top such that the front side and rear side can be folded together into a closed position where the front side and rear side are essentially in parallel or opened about the top into an operational position where the front side and rear side are at an angular relationship and a workman can climb to a desired rung and perform whatever work is desired;

a conduit holder attached to the front side for holding conduit; and a first wire spool holder that is a tab with a hole attached to and below one of the front rungs of the front side between the first front rail and the second front rail and a second wire spool holder that is a tab with a hole attached to and below one of the rear rungs of the rear side between the first rear rail and the second rear rail through which a conduit having a wire spool extend, the first wire spool holder separate and apart from the second wire spool holder.

2. The stepladder of claim 1 including a hacksaw hook attached to the front side.

3. The stepladder as described in claim 2 wherein the conduit holder includes a first side shield and a second side shield attached to the first front rail and the second front rail respectively, to protect the respective front rail.

4. The stepladder as described in claim 3 wherein the conduit holder includes a first hook and a second hook, and a bar to which the first and second hooks are connected in alignment with each other; by moving the bar, the first and second hooks move in unison with the bar between a retracted position and an open position.

5. A stepladder as described in claim 4 wherein the conduit holder includes a first mounting bracket connected to the first front rail and the first hook, and a second mounting bracket connected to the second front rail and the second hook.

6. A stepladder comprising:

a front side, said front side comprised of a first front rail, and a second front rail in parallel with the first front rail and in spaced relationship therewith, said front side also comprised of a plurality of front rungs, each front rung being connected to the first front rail and the second front rail and perpendicular thereto, each front rung in parallel and in spaced relationship with the other front rungs;

a rear side, said rear side comprised of a first rear rail and a second rear rail in parallel with the first rear rail and in spaced relationship therewith, said rear side also comprised of a plurality of rear rungs, each rear rung connected to the first rear rail and the second rear rail and perpendicular thereto, each rear rung in parallel and in spaced relationship with the other rear rungs;

a top, said front side and rear side attached to the top such that the front side and rear side can be folded together into a closed position where the front side and rear side are essentially in parallel or opened about the top into an operational position where the front side and rear side are at an angular relationship and a workman can climb to a desired rung and perform whatever work is desired;

a conduit holder attached to the front side for holding conduit; and a first wire spool holder attached to and below one of the front rungs of the front side between the first front rail and the second front rail and a second wire spool holder attached to and below one of the rear rungs of the rear side between the first rear rail and the second rear rail through which a conduit having a wire spool extend, the first wire spool holder separate and apart from the second wire spool holder.

* * * * *